US011680709B2

(12) United States Patent
Ramotowski et al.

(10) Patent No.: US 11,680,709 B2
(45) Date of Patent: Jun. 20, 2023

(54) FLASHBACK RESISTANT PREMIXED FUEL INJECTOR FOR A GAS TURBINE ENGINE

(71) Applicant: Solar Turbines Incorporated, San Diego, CA (US)

(72) Inventors: Michael J. Ramotowski, San Diego, CA (US); Paul Economo, San Diego, CA (US); Christian Di Norscia, San Diego, CA (US); Donald J. Cramb, San Diego, CA (US); Nathan J. Kirksey, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 69 days.

(21) Appl. No.: 17/080,410

(22) Filed: Oct. 26, 2020

(65) Prior Publication Data

US 2022/0128237 A1 Apr. 28, 2022

(51) Int. Cl.

| | |
|---|---|
| ***F23R 3/00*** | (2006.01) |
| ***F23R 3/28*** | (2006.01) |
| ***F23R 3/14*** | (2006.01) |
| *F23R 3/34* | (2006.01) |

(52) U.S. Cl.

CPC ..... *F23R 3/286* (2013.01); *F23R 3/14* (2013.01); *F05D 2240/35* (2013.01); *F23D 2206/10* (2013.01); *F23D 2209/30* (2013.01); *F23D 2900/14021* (2013.01); *F23R 3/343* (2013.01)

(58) Field of Classification Search

None

See application file for complete search history.

(56) References Cited

U.S. PATENT DOCUMENTS 5,778,676 A * 7/1998 Joshi ..... F23D 17/002 60/737
8,065,880 B2 11/2011 Ishizaka et al.
8,991,188 B2 3/2015 Bailey et al.
(Continued)

FOREIGN PATENT DOCUMENTS

EP 1873455 B1 5/2015
JP 4571612 B2 8/2010
(Continued)

OTHER PUBLICATIONS

Written Opinion and International Search Report for Int'l. Patent Appln. No PCT/US2021/051204, dated Jul. 8, 2022 (10 pgs).

*Primary Examiner* — Edwin Kang

(74) *Attorney, Agent, or Firm* — Procopio, Cory, Hargreaves & Savitch LLP

(57) ABSTRACT

A fuel injector is disclosed for reducing flashback. In an embodiment, the fuel injector may comprise an injector head with purge holes on a radial wall along a radial axis between an assembly axis of the fuel injector and a plurality of vanes arranged circumferentially around the assembly axis. In addition, the plurality of vanes may comprise fuel outlets connecting interior fuel passages to spaces between the vanes. The introduction of these purge holes near the bases of the vanes and the configuration and positioning of the fuel outlets in the vanes and elsewhere in the fuel injector may alter the stoichiometry (e.g., fuel-air ratio) within the premix passage of the fuel injector to reduce flashback. A plurality of such fuel injectors may be used in the combustor of a gas turbine engine.

18 Claims, 7 Drawing Sheets

(56) References Cited

U.S. PATENT DOCUMENTS

| | | | | |
|---|---|---|---|---|
| 9,441,835 | B2 | 9/2016 | Overby et al. | |
| 10,641,493 | B2 | 5/2020 | Johnson et al. | |
| 2004/0003596 | A1* | 1/2004 | Chin | F23R 3/343 60/737 |
| 2005/0262843 | A1* | 12/2005 | Monty | F23R 3/28 60/748 |
| 2008/0000234 | A1 | 1/2008 | Commaret et al. | |
| 2008/0066720 | A1* | 3/2008 | Piper | F23R 3/286 123/470 |
| 2010/0293954 | A1* | 11/2010 | Widener | F23R 3/283 60/740 |
| 2011/0271682 | A1* | 11/2011 | Sandelis | F23R 3/14 60/737 |
| 2012/0111012 | A1* | 5/2012 | Axelsson | F23R 3/14 60/737 |
| 2013/0189632 | A1 | 7/2013 | Menon et al. | |
| 2014/0331677 | A1* | 11/2014 | Cramb | F02C 7/232 60/740 |
| 2014/0332602 | A1* | 11/2014 | Cramb | F23R 3/14 239/104 |
| 2017/0003030 | A1 | 1/2017 | Benjamin et al. | |
| 2017/0191457 | A1* | 7/2017 | Spivey | F02M 61/163 |
| 2017/0191667 | A1* | 7/2017 | Spivey | F23R 3/286 |
| 2017/0299190 | A1* | 10/2017 | Patel | F23R 3/286 |
| 2018/0100652 | A1* | 4/2018 | Vranjic | F23R 3/28 |
| 2020/0033006 | A1* | 1/2020 | Miyamoto | F02C 7/222 |

FOREIGN PATENT DOCUMENTS

| | | | |
|---|---|---|---|
| JP | 4899221 | B2 | 1/2012 |
| JP | 2020-034271 | A | 3/2020 |

* cited by examiner

FLASHBACK RESISTANT PREMIXED FUEL INJECTOR FOR A GAS TURBINE ENGINE

TECHNICAL FIELD

The embodiments described herein are generally directed to a fuel injector, and, more particularly, to a fuel injector with purge holes and fuel-injection outlets that reduce the fuel injector's propensity to flashback.

BACKGROUND

A lean premixed fuel injector is susceptible to flashback if specific criteria or operating conditions are met. Thus, it is necessary to include features that reduce or remove the fuel injector's propensity to flashback. For example, U.S. Patent Publication No. 2013/0189632 A1 describes a fuel nozzle with a nozzle collar that includes a number of air vanes. Purge holes are positioned through the air vanes to create a flow of purge air that is intended to disrupt recirculation zones downstream from the fuel nozzle. The present disclosure is directed toward overcoming one or more of the problems discovered by the inventors.

SUMMARY

In an embodiment, an injector head for a fuel injector is disclosed that comprises: an injector body comprising an injector portion shaped as a hyperbolic funnel rotated around an assembly axis, wherein, in a cross section along the assembly axis, a wall of the injector portion transitions from a radial axis, which is orthogonal to the assembly axis, to an axis that is parallel to the assembly axis; and a premix barrel encircling the injector portion around the assembly axis and defining a premix passage between the premix barrel and the injector portion, wherein a radial portion of the wall of the injector portion that is along the radial axis comprises a plurality of purge holes that connect the premix passage to an injector cavity, which is interior to the injector portion.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

For clarity and ease of explanation, some surfaces and details may be omitted in the present description and figures. In addition, references herein to "upstream" and "downstream" are relative to the flow direction of the primary gas (e.g., air) used in the combustion process, unless specified otherwise. It should be understood that "upstream" refers to a position that is closer to the source of the primary gas or a direction towards the source of the primary gas, and "downstream" refers to a position that is farther from the source of the primary gas or a direction that is away from the source of the primary gas.

Figure 1:
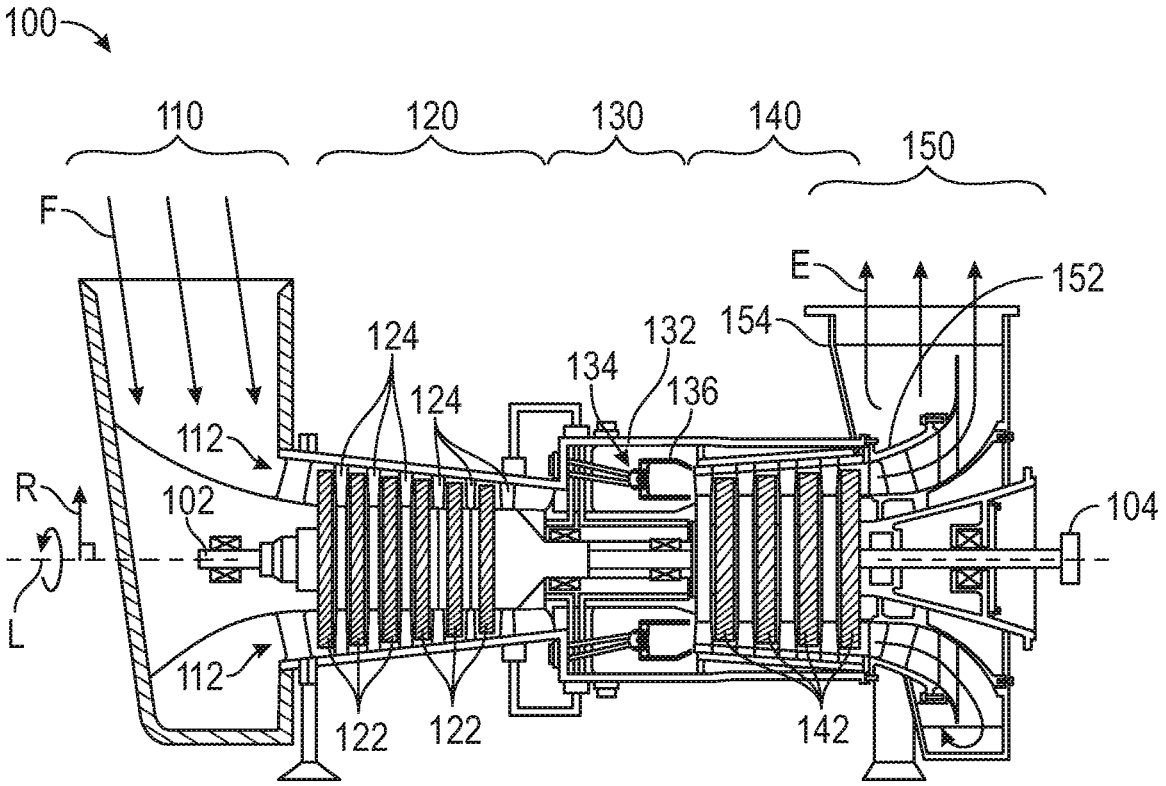
FIG. 1 illustrates a schematic diagram of a gas turbine engine, according to an embodiment.

FIG. 1 illustrates a schematic diagram of a gas turbine engine 100, according to an embodiment. Gas turbine engine 100 comprises a shaft 102 with a central longitudinal axis L. A number of other components of gas turbine engine 100 are concentric with longitudinal axis L, and all references herein to radial, axial, and circumferential directions are relative to longitudinal axis L. A radial axis may refer to any axis or direction that radiates outward from longitudinal axis L at a substantially orthogonal angle to longitudinal axis L, such as radial axis R in FIG. 1. As used herein, the term "axial" will refer to any axis or direction that is substantially parallel to longitudinal axis L.

In an embodiment, gas turbine engine 100 comprises, from an upstream end to a downstream end, an inlet 110, a compressor 120, a combustor 130, a turbine 140, and an exhaust outlet 150. In addition, the downstream end of gas turbine engine 100 may comprise a power output coupling 104. One or more, including potentially all, of these components of gas turbine engine 100 may be made from stainless steel and/or durable, high-temperature materials known as "superalloys." A superalloy is an alloy that exhibits excellent mechanical strength and creep resistance at high temperatures, good surface stability, and corrosion and oxidation resistance. Examples of superalloys include, without limitation, Hastelloy, Inconel, Waspaloy, Rene alloys, Haynes alloys, Incoloy, MP98T, TMS alloys, and CMSX single crystal alloys.

Inlet 110 may funnel a working fluid F (e.g., a gas, such as air) into an annular flow path 112 around longitudinal axis L. Working fluid F flows through inlet 110 into compressor 120. While working fluid F is illustrated as flowing into inlet 110 from a particular direction and at an angle that is substantially orthogonal to longitudinal axis L, it should be understood that inlet 110 may be configured to receive working fluid F from any direction and at any angle that is appropriate for the particular application of gas turbine engine 100.

Compressor 120 may comprise a series of compressor rotor assemblies 122 and stator assemblies 124. Each compressor rotor assembly 122 may comprise a rotor disk that is circumferentially populated with a plurality of rotor blades. The rotor blades in a rotor disk are separated, along the axial axis, from the rotor blades in an adjacent disk by a stator assembly 124. Compressor 120 compresses working fluid F through a series of stages corresponding to each compressor rotor assembly 122. The compressed working fluid F then flows from compressor 120 into combustor 130.

Combustor 130 may comprise a combustor case 132 housing one or more, and generally a plurality of, fuel injectors 134. In an embodiment with a plurality of fuel injectors 134, fuel injectors 134 may be arranged circumferentially around longitudinal axis L within combustor case 132 at equidistant intervals. Combustor case 132 diffuses working fluid F, and fuel injector(s) 134 inject fuel into working fluid F. This injected fuel is ignited to produce a combustion reaction in one or more combustion chambers 136. The combusting fuel-gas mixture drives turbine 140.

Turbine 140 may comprise one or more turbine rotor assemblies 142. As in compressor 120, each turbine rotor assembly 142 may correspond to one of a series of stages. Turbine 140 extracts energy from the combusting fuel-gas mixture as it passes through each stage of the one or more turbine rotor assemblies 142. The energy extracted by turbine 140 may be transferred (e.g., to an external system) via power output coupling 104.

The exhaust E from turbine 140 may flow into exhaust outlet 150. Exhaust outlet 150 may comprise an exhaust diffuser 152, which diffuses exhaust E, and an exhaust collector 154 which collects, redirects, and outputs exhaust E. It should be understood that exhaust E, output by exhaust collector 154, may be further processed, for example, to reduce harmful emissions, recover heat, and/or the like. In addition, while exhaust E is illustrated as flowing out of exhaust outlet 150 in a specific direction and at an angle that is substantially orthogonal to longitudinal axis L, it should be understood that exhaust outlet 150 may be configured to output exhaust E towards any direction and at any angle that is appropriate for the particular application of gas turbine engine 100.

Figure 2:
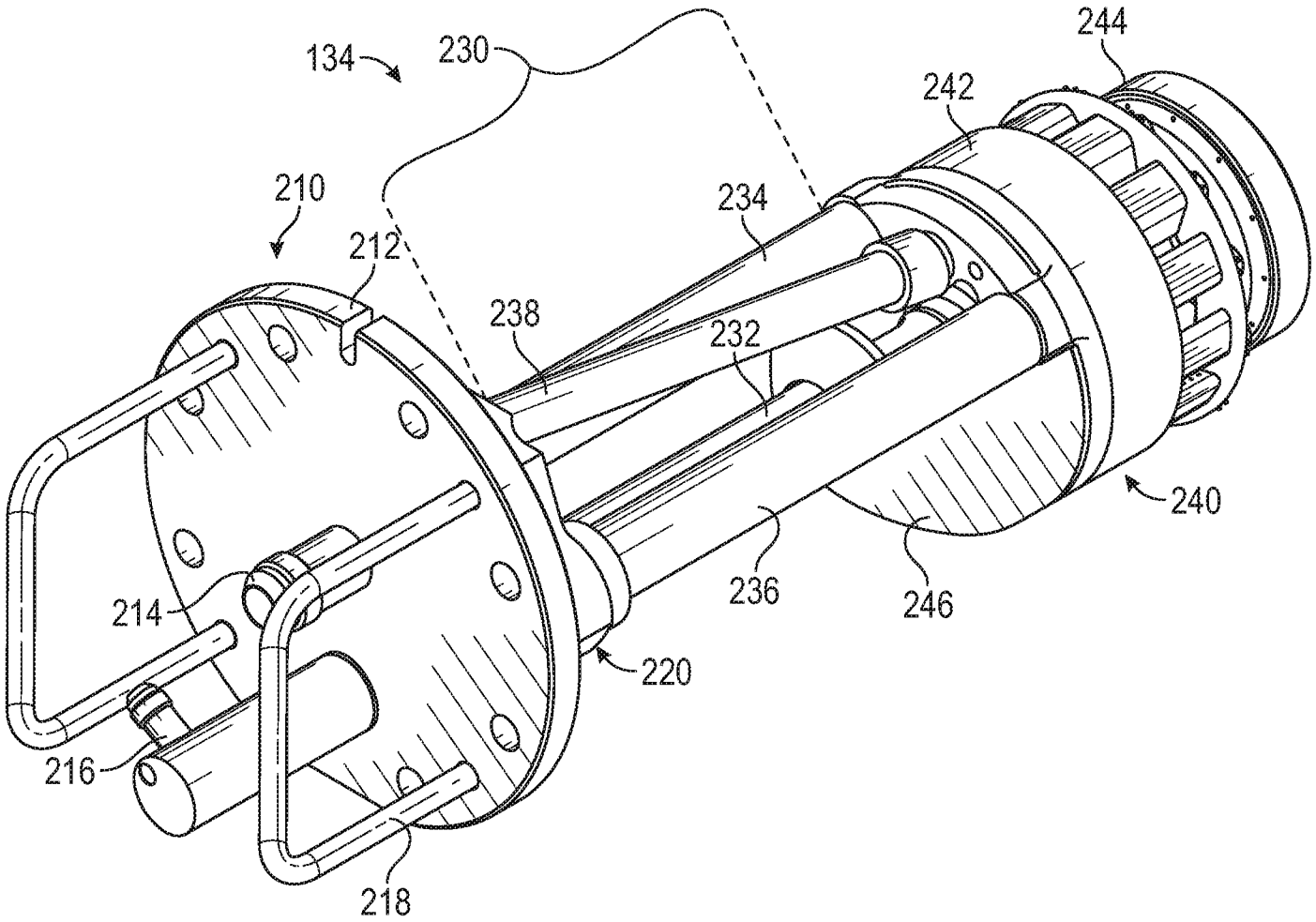
FIG. 2 illustrates a perspective view of a fuel injector, according to an embodiment.
Figure 3:
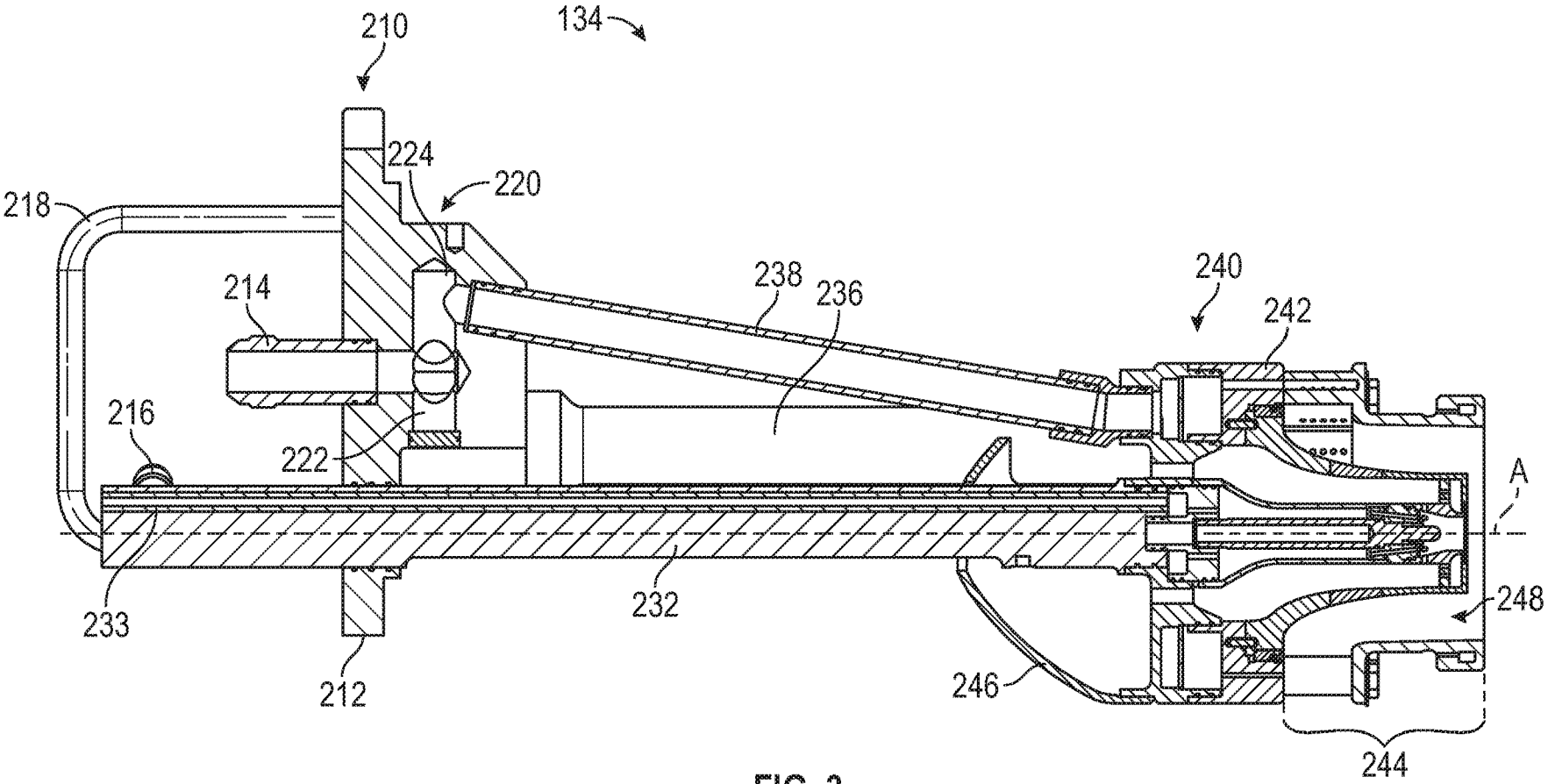
FIG. 3 illustrates a cross-sectional view of fuel injector, according to an embodiment.

FIG. 2 illustrates a perspective view of a fuel injector 134, and FIG. 3 illustrates a cross-sectional view of the same fuel injector 134, according to an embodiment. In the illustrated embodiment, each fuel injector 134 comprises a flange assembly 210, a distribution block 220, fuel tubes 230, and an injector head 240, assembled along an assembly axis A. In embodiments in which combustor 130 comprises a plurality of fuel injectors 134, each of the plurality of fuel injectors 134 may be identical in structure.

Flange assembly 210 may comprise a flange 212, a main fuel fitting 214, a pilot fuel fitting 216, and one or more handles 218. Flange 212 may be a cylindrical disk comprising apertures for fastening fuel injector 134 to combustor case 130. Main fuel fitting 214 and pilot fuel fitting 216 may provide inlets for the introduction of dual fuel sources to separate and distinct main fuel and pilot fuel circuits, respectively. As illustrated, the center of flange 212, through which primary fuel fitting 214 extends, may be offset from assembly axis A.

Distribution block 220 may extend in an axial downstream direction from flange 212. Flange 212 and distribution block 220 may be formed from a single integral piece of material, or may be formed as separate pieces of material that are joined by any known means. Distribution block 220 acts as a manifold for one or more fuel circuits that distribute the flow of fuel through multiple fuel tubes 230.

Fuel tubes 230 may comprise a tube stem 232, a first main tube 234, a second main tube 236, and a secondary tube 238. First main tube 234 and second main tube 236, which may be parallel to each other and to assembly axis A, may form part of a first main fuel circuit. Secondary tube 238 may extend between distribution block 220 and injector head 230 at an angle relative to assembly axis A, first main tube 234, and second main tube 236, and form part of the first main fuel circuit or a second main fuel circuit. In an embodiment, secondary tube 238 forms a part of the first main fuel circuit with first main tube 234 and second main tube 236. In addition, secondary tube 238 may act as a support tube for injector head 240 to prevent deflection of injector head 240.

Injector head 240 may be connected to fuel tubes 230 via respective fittings, and may comprise an injector body 242, premix barrel 244, and outer cap 246. The fittings of fuel tubes 230 to injector head 240 may be configured to join fluid passageways through tube stem 232, first main tube 234, second main tube 236, and secondary tube 238 to passageways in injector body 242. In addition, outer cap 246 may comprise one or more openings that enable discharge gas (e.g., air) from compressor 120 to enter injector body 242.

Fuel injector 134 may comprise a plurality of internal passageways therethrough, including one or more main fuel circuits that are in fluid communication with main fuel fitting 214 and a pilot fuel circuit that is in fluid communication with pilot fuel fitting 216. Together, these passageways can form a dual-fuel delivery system for receiving main fuel and pilot fuel at flange assembly 210 and distributing the main fuel and pilot fuel through injector head 240 into a premix passage 248 illustrated in FIG. 3.

As illustrated in FIG. 3, primary fuel fitting 214 may provide fluid communication to at least two branching passages 222 and 224 through distribution block 220. Passage 222 may provide fluid communication through first main tube 234 and/or second main tube 236 to injector head 240, and passage 224 may provide fluid communication through secondary tube 238, as part of the main fuel circuit. In addition, pilot fuel fitting 216 may provide fluid communication to a passage through a pilot fuel tube 233 extending through tube stem 232, which extends through flange 212 to injector head 240, as part of the pilot fuel circuit. Pilot fuel tube 233 may be shaped as a hollow cylinder through an otherwise solid tube stem 232. The main fuel circuit and the pilot fuel circuit provide dual fuel paths through fuel injector 134 to various outlets in injector head 240.

Figure 4:
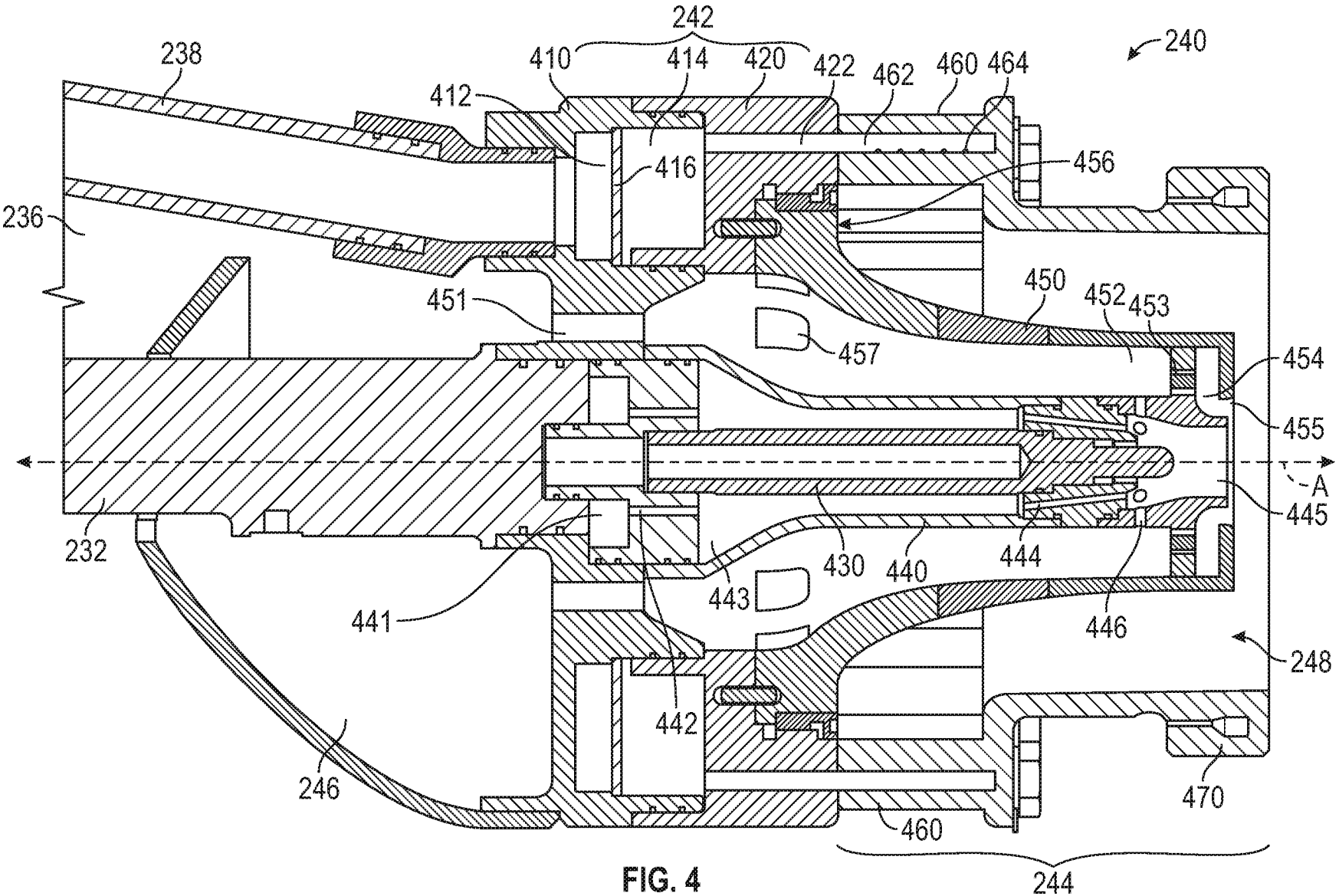
FIG. 4 illustrates a cross-sectional view of a head of a fuel injector, according to an embodiment.

FIG. 4 illustrates a cross-sectional view of injector head 240, according to an embodiment. As illustrated, injector head 240 may comprise a first portion 410, a second portion 420, a pilot tube 430, a central portion 440, an injector portion 450, a plurality of vanes 460, and a barrel 470. Injector body 242 comprises first portion 410, second portion 420, pilot tube 430, central portion 440 coaxial around pilot tube 430, and injector portion 450 coaxial around central portion 440. Premix barrel 244 comprises the plurality of vanes 460 and barrel 470. While premix barrel 244 is illustrated with twelve vanes 460, premix barrel 244 may comprise any suitable number of vanes 460. Outer cap 246 may be a dome-shaped cap that is connected to and extends upstream from the upstream end of first body 410. These various portions may be formed as separate pieces and affixed to each other in any known manner (e.g., metallurgical bonding, such as by brazing or welding; fasteners, such as screws or bolts; etc.). Alternatively, any subset, including all, of the described portions may be formed as a single integrated piece.

In an embodiment, the main fuel circuit, which may comprise passageways through first main tube 234, second main tube 236, and secondary tube 238, provides fluid communication from main fuel fitting 214 to an annular cavity 412 that extends circumferentially around assembly axis A within first portion 410. Annular main fuel cavity 412 is in fluid communication with an annular main fuel gallery 414, which also extends circumferentially around assembly axis A, via an annular perforated plate 416 between main fuel cavity 412 and main fuel gallery 414. The perforations in perforated plate 146 may be configured in size, shape, spacing, and/or density to restrict fluid flow and dampen the oscillation response of combustor 130.

Main fuel gallery 414 may be in fluid communication with a plurality of first main fuel passages 422 through second portion 420. In turn, each first main fuel passage 422 may be in fluid communication with a respective second main fuel passage 462 into one of the plurality of vanes 460. Each of these vanes 460 may comprise one or more main fuel outlets 464 from its respective second main fuel passage 462 to an exterior of the vane 460, so as to be in fluid communication with premix passage 248. The combinations of each first main fuel passage 422 with a respective second main fuel passage 462 form a plurality of axial main fuel passageways, spaced circumferentially around assembly axis A, that each provide a flow path from main fuel gallery 414 through one of the plurality of vanes 460 and out that vane's main fuel outlet(s) 464 to premix passage 248.

In an embodiment, each vane 460 comprises a set of five main fuel outlets 464 arranged along an axial line with respect to each other. Each main fuel outlet 464 may extend transversely through a wall of the respective vane 460. Main fuel outlets 464 may be provide a flow path through an exterior surface of each vane 460 between adjacent vanes 460, such that the main fuel flows out of main fuel outlets 464 into spaces between adjacent vanes 460. In other words, each main fuel outlet 464 may connect to premix passage 248 on a side of its respective vane 460 that faces a space between the respective vane 460 and an adjacent vane 460. Each vane 460 may have a wedge shape with a truncated tip that is configured to direct gas (e.g., air) into premix passage 248. However, the shape of vanes 460 is not limited to such a shape. In general, vanes 460 may be shaped to generate swirl to promote the formation of zones of recirculation of the fuel-gas mixture in combustion chamber 136.

Main fuel outlets 464 on a given vane 460 may be spaced apart from each other at equidistant intervals along an axial line, and the main fuel outlets 464 on each end of the axial line of main fuel outlets 464 may be spaced apart from an axial end of vane 460 by a distance. These intervals and distances may be selected according to an oscillation response of combustor 130. In an embodiment, each main fuel outlet 464 is circular in profile and identical. However, main fuel outlets 464 may have non-circular profiles (elliptical, rectangular, triangular, irregular polygonal, etc.) and/or may be differ from each other in size, shape, and/or relative spacing.

In an embodiment, the pilot fuel circuit, which may comprise a passageway through pilot fuel tube 233 in tube stem 232, provides fluid communication from pilot fuel fitting 216 to an annular pilot fuel gallery 441 that extends circumferentially around assembly axis A in central portion 440. Pilot fuel gallery 441 may be in fluid communication with one or more axial pilot fuel distribution passages 442, which may be configured in size, spacing, shape, and/or density for dampening the oscillation response of combustor 130. In turn, each pilot fuel distribution passage 442 may be in fluid communication with an annular central pilot fuel cavity 443 that extends circumferentially around assembly axis A and encircles pilot tube 430. In turn, central pilot fuel cavity 443 may be in fluid communication with one or more axial pilot-block passages 444. In turn, each pilot-block passage 444 may be in fluid communication with a pilot premix passage 445 that is open to premix passage 248 at the downstream end. The downstream tip of central portion 440 may also comprise one or more radial tip passages 446 that provide fluid communication between pilot premix passage 445 and an injector cavity 452 within injector portion 450.

In an embodiment, first portion 410 comprises an annular feed passage 451 that extends circumferentially around assembly axis A and receives a gas (e.g., air), at its upstream end, from compressor 120 via opening(s) in outer cap 246. Feed passage 451 may be in fluid communication, at a downstream end, with an annular injector cavity 452 in injector portion 450 that extends circumferentially around assembly axis A and encircles central portion 440. In turn, injector cavity 452 may be in fluid communication with one or more axial gas passages 453 in injector portion 450. In turn, each gas passage 453 may be in fluid communication with an annular tip cavity 454 in injector portion 450 that extends circumferentially around assembly axis A and encircles the downstream tip of central portion 440. In turn, tip cavity 454 may be in fluid communication with an injector opening 455 at the downstream end of injector portion 450. The combination of feed passage 451, injector cavity 452, axial gas passage(s) 453, tip cavity 454, and injector opening 455 provides a flow path for gas (e.g., air) through injector portion 450 around assembly axis A. In addition, radial tip passage(s) 446 through the downstream tip of central portion 440 provide a flow path for gas from injector cavity 452 into pilot premix passage 445 of central portion 440.

In an embodiment, injector portion 450 may be shaped as a hyperbolic funnel rotated around assembly axis A. Thus, as illustrated in FIG. 4, at the upstream end of injector portion 450, the walls of injector portion 450 may transition from a radial axis to an axial direction relative to assembly axis A. Accordingly, injector portion 450 may comprise a radial wall 456 that defines a portion of premix passage 248. One or more purge holes 457 may be formed through radial wall 456 to provide fluid communication between premix passage 248 and injector cavity 452.

Figure 5:
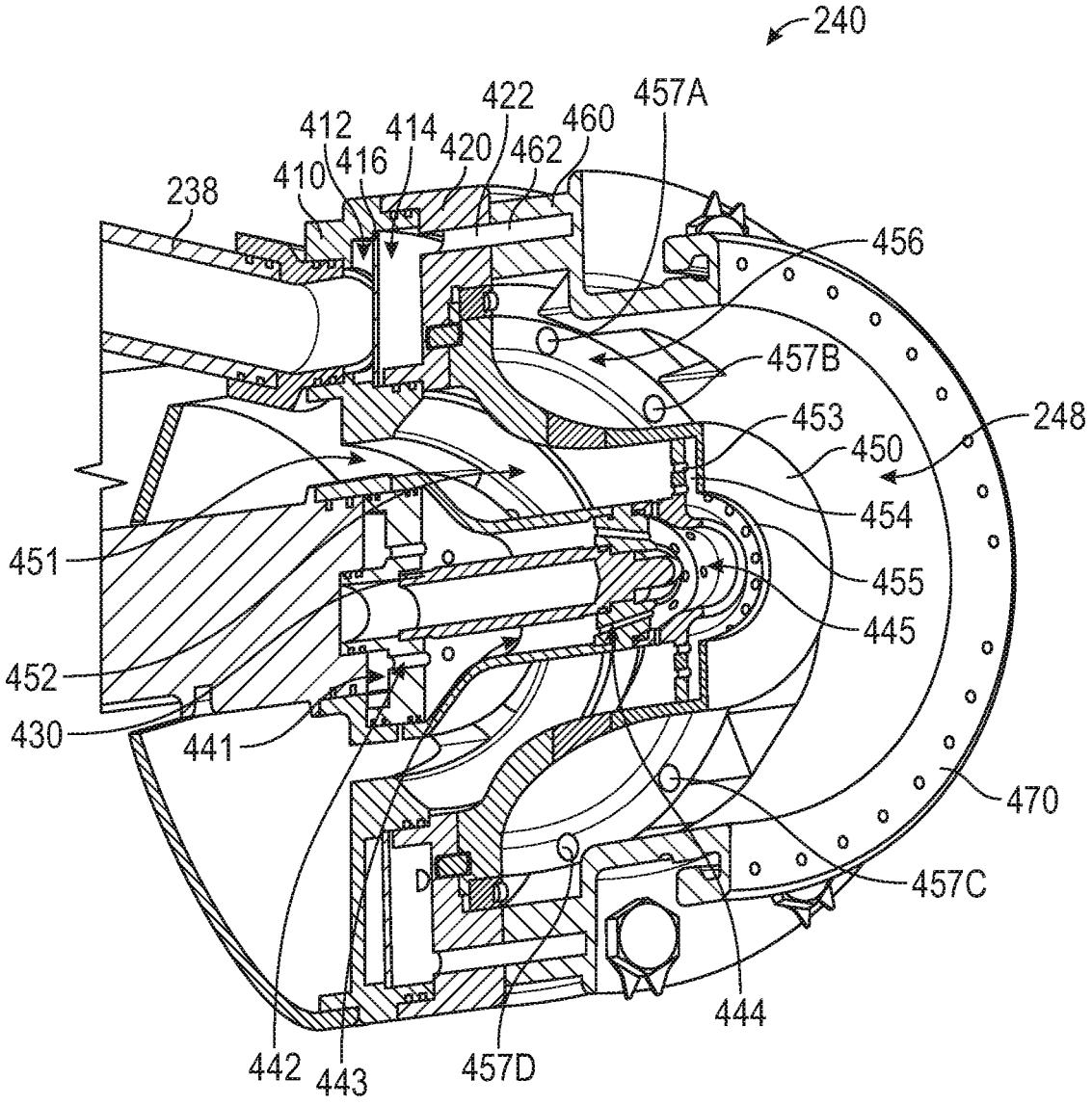
FIG. 5 illustrates the cross-sectional view of the head of the fuel injector in FIG. 4 in perspective, according to an embodiment.

FIG. 5 illustrates a perspective cross-sectional view of injector head 240, according to an embodiment. As illustrated, injector portion 450 may comprise a plurality of purge holes 457 through radial wall 456. Purge holes 457A, 457B, 457C, and 457D are visible in FIG. 5. Purge holes 457 may be arranged circumferentially around assembly axis A at equidistant intervals from each other. In an embodiment, one purge hole 457 is positioned in radial wall 456, along a radial axis between assembly axis A and each vane 460, at or near the base of the trailing edge of the vane 460. Although a certain number and arrangement of purge holes 457 (e.g., twelve purge holes 457) are illustrated in FIG. 5, radial wall 456 may comprise any number and/or arrangement of purge holes 457. In an embodiment, there is a one-to-one correspondence between purge holes 457 and vanes 460, such that each purge hole 457 corresponds to exactly one vane 460, and each vane 460 corresponds to exactly one purge hole 457.

Figure 6:
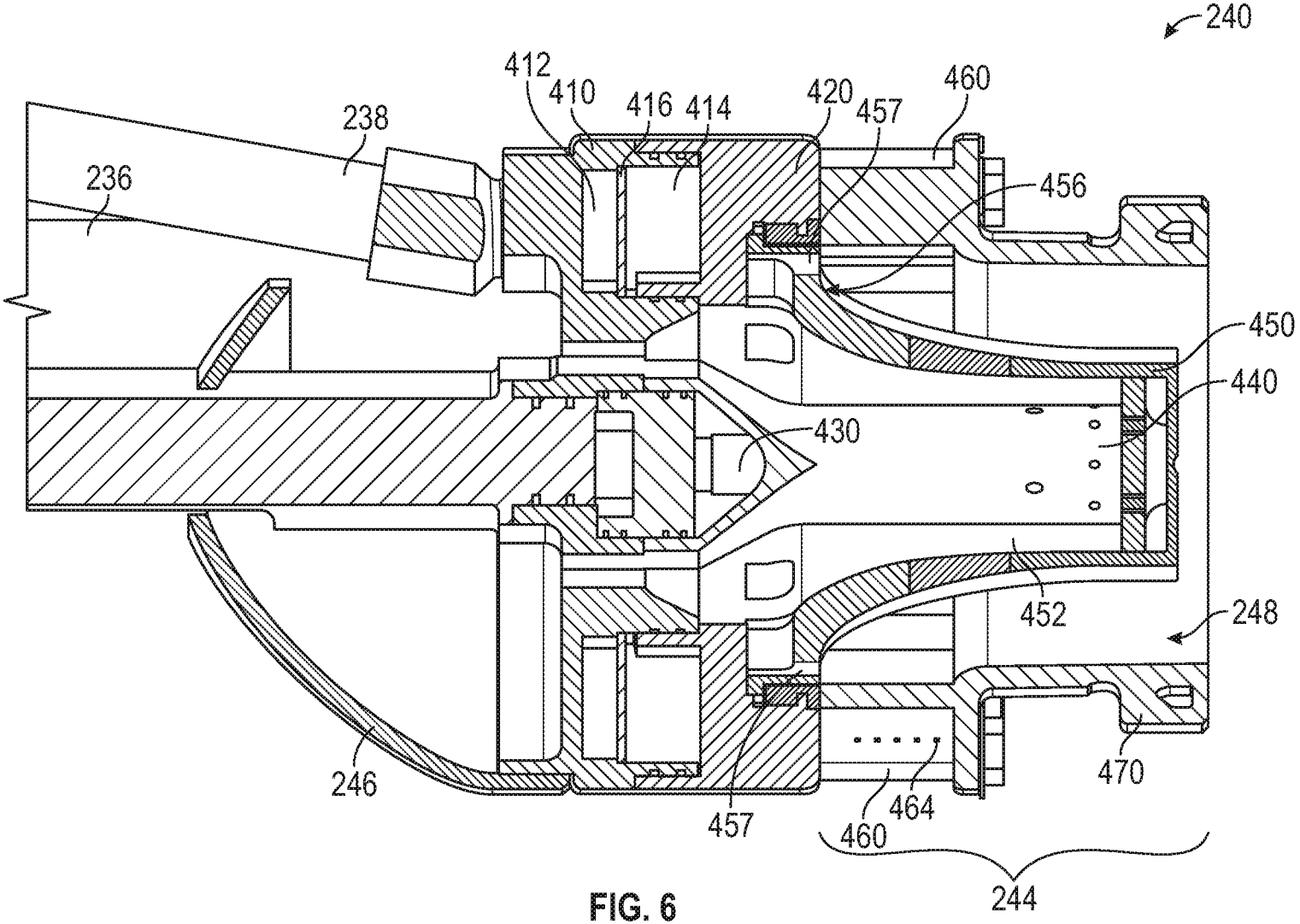
FIG. 6 illustrates a cross-sectional view of the head of the fuel injector in FIGS. 4 and 5 at a shallower cut depth, according to an embodiment.

FIG. 6 illustrates a cross-sectional view of injector head 240 at a shallower cut depth than in FIG. 4, according to an embodiment. As illustrated in in FIG. 6, each purge hole 457 provides fluid communication through radial wall 456 of injector portion 450 to allow gas (e.g., air) to flow between injector cavity 452 and an upstream portion of premix passage 248. Notably, in the illustrated embodiment, there are no purge holes on the trailing edges of vanes 460. Such purge holes may negatively affect the stoichiometry in premix passage 248 and increase flashback.

Figure 7:
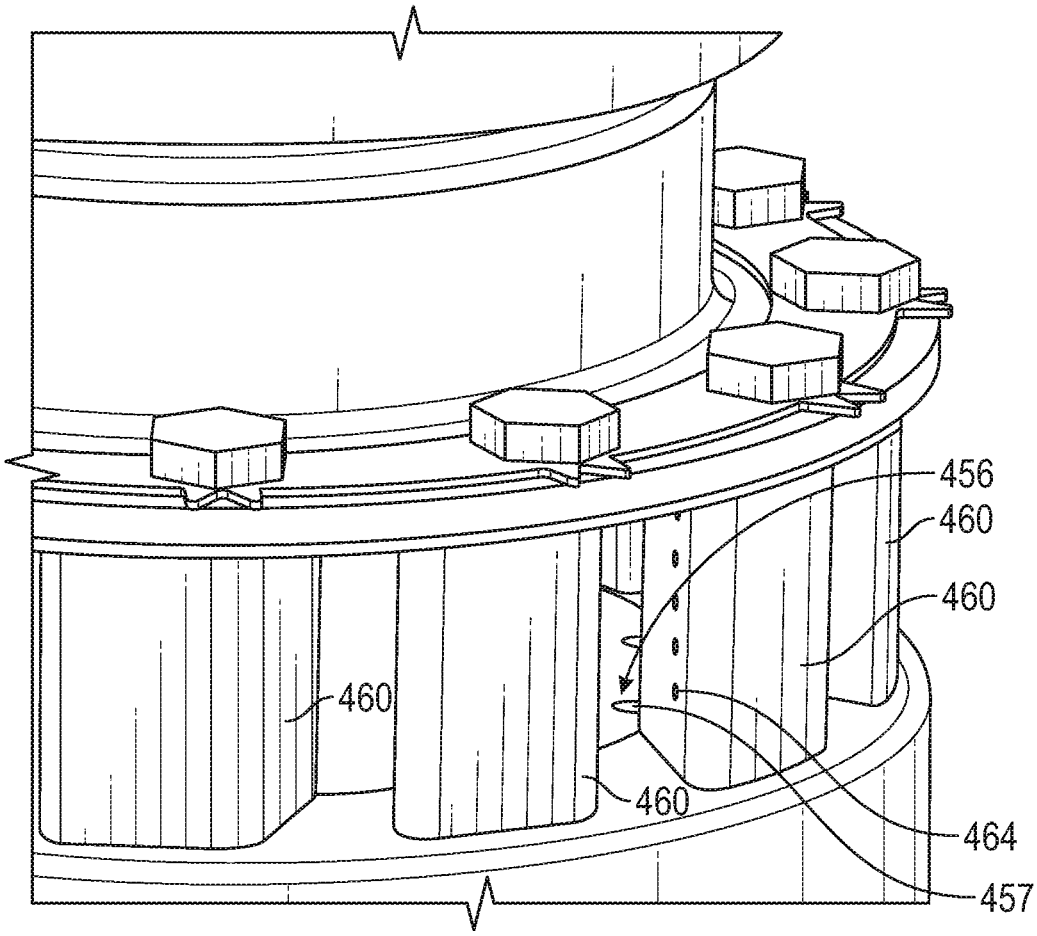
FIG. 7 illustrates a perspective view of a portion of the head of a fuel injector, according to an embodiment.

FIG. 7 illustrates a perspective view of a portion of injector head 240, according to an embodiment. As illustrated, a plurality of truncated-wedge-shaped vanes 460 are arranged circumferentially around premix barrel 244 at equidistant intervals, with the trailing edge of each vane 460 facing into premix passage 248. One or more, including potentially all, of vanes 460 may comprise a set of axially aligned main fuel outlets 464. For example, in the illustrated embodiment, each set of main fuel outlets 464 on each vane 460 consists of five main fuel outlets 464. Thus, in the illustrated fuel injector 134 with twelve vanes 460, there are a total of sixty main fuel outlets 464. In an embodiment, fuel injector 134 may consist of only the main fuel outlets 464 on vanes 460 (e.g., sixty main fuel outlets), with no other outlets for the main fuel. Each main fuel outlet 464 may dispense main fuel from the main fuel circuit into spaces between vanes 460, which are in open fluid communication with premix passage 248. Main fuel outlets 464 may be sized to maintain a proper fuel system pressure drop across fuel injector 134. Notably, purge holes 457 through radial wall 456 of injector portion 450 are also visible in FIG. 7 through the spaces between vanes 460.

INDUSTRIAL APPLICABILITY

Gas turbine engines 100 are used in various industrial applications. Examples of such applications include, the oil and fuel industry (e.g., for the transmission, collection, storage, withdrawal, and/or lifting of oil and natural gas), the power generation and cogeneration industries, the aerospace industry, other transportation industries, and the like.

In an embodiment, during operation of gas turbine engine 100, compressed working fluid F (e.g., air) from compressor 120 enters premix passage 248 through the spaces between vanes 460. This working fluid F mixes with the main fuel discharged from main fuel outlets 464. Premix passage 248 discharges this fuel-gas (e.g., fuel-air) mixture into a combustion chamber 136 for combustion.

The configuration and position of main fuel outlets 464 and purge holes 457 in fuel injector 134 alters the stoichiometry (e.g., fuel-to-air ratio) in premix passage 248, in a manner that reduces flame propagation towards vanes 460 and flashback. Specifically, regions of premix passage 248 near the trailing edges of vanes 460 are prone to have recirculation and a fuel-gas mixture that is conducive to a reaction. Purge holes 457 at or near the bases of vanes 460 remove stagnant recirculation zones and introduce gas (e.g., air) that manipulate the gas side of local fuel-to-gas ratio to lean out the fuel-gas mixture within combustion chamber 136 along the wall of injector portion 450. In addition, the size, arrangement, and position of main fuel outlets 464 manipulate the fuel side of the local fuel-to-gas ratio to obtain an appropriate local stoichiometry. These effects reduce the reaction in these regions of premix passage 248 and thereby reduce the propensity for flashback in these regions. In other words, the disclosed features lower the flammability of the fuel-gas mixture along the exterior surface of injector portion 450, and therefore, reduce the propensity for a flame to travel along this exterior surface to vanes 460 and flashback. In an embodiment, to improve these effects, vanes 460 do not comprise any purge holes along their trailing edges.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of gas turbine engine or a particular combustor. Hence, although the present embodiments are, for convenience of explanation, depicted and described as being implemented in a particular fuel injector for a particular combustor in a particular gas turbine engine, it will be appreciated that it can be implemented in various other types of fuel injectors (e.g., dual fuel injectors, such as Dry Low Emissions (DLE) dual fuel (DF) and Lean Direction Injection (LDI) DF fuel injection systems), combustors, gas turbine engines, and/or turbomachines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. An injector head for a fuel injector, the injector head comprising:

an injector body comprising an injector portion shaped as a hyperbolic funnel rotated around an assembly axis, wherein, in a cross section along the assembly axis, a wall of the injector portion transitions from a radial axis, which is orthogonal to the assembly axis, to an axis that is parallel to the assembly axis; and a premix barrel encircling the injector portion around the assembly axis and defining a premix passage wherein air and fuel are mixed, the premix passage located between the premix barrel and the injector, the premix barrel further comprises a plurality of vanes in the premix passage and spaced apart at equidistant intervals circumferentially around at least a portion of the injector portion and around the assembly axis, wherein each of the plurality of vanes comprises a fuel passage in an interior of each vane and one or more fuel outlets connecting the fuel passage to the premix passage, wherein a radial portion of the wall of the injector portion that is along the radial axis comprises a plurality of purge holes that connect the premix passage to an injector cavity, which is radially interior to the premix passage and wherein each of the plurality of purge holes is positioned on the radial portion of the wall of the injector portion along the radial axis between the assembly axis and one of the plurality of vanes, and wherein each of the plurality of purge holes comprises an inlet portion parallel to a radial direction with respect to the assembly axis and an outlet portion parallel to the assembly axis.

2. The injector head of claim 1, wherein, for each of the plurality of vanes, each of the one or more fuel outlets connects to the premix passage on a side of each vane that faces a space between each vane and an adjacent vane.

3. The injector head of claim 1, wherein the one or more fuel outlets in the plurality of vanes are the only outlets for main fuel in the injector head.

4. The injector head of claim 1, wherein none of the plurality of vanes comprise any purge holes.

5. The injector head of claim 1, wherein a number of the plurality of purge holes is equal to a number of the plurality of vanes.

6. The injector head of claim 1, wherein the injector body further comprises, for each of the plurality of vanes, a fuel passage that connects the fuel passage in each vane to a main fuel gallery in the injector body.

7. The injector head of claim 1, wherein the injector body further comprises:

one or more feed passages that connect the injector cavity to an exterior of the injector body that is upstream from the injector cavity; and an axial downstream flow path from the one or more feed passages through the injector cavity to an opening in a downstream end of the injector portion.

8. The injector head of claim 1, wherein the injector body further comprises a central portion that is coaxial to the injector portion and within the injector cavity, wherein the central portion comprises an axial downstream flow path from an upstream end of the central portion to an opening in a downstream end of the central portion.

9. The injector head of claim 8, wherein a tip of the central portion at the downstream end of the central portion comprises one or more radial tip passages that radially connect the injector cavity to the axial downstream flow path of the central portion.

10. The injector head of claim 8, wherein the injector body further comprises a pilot tube that is coaxial to the central portion.

11. A fuel injector comprising:

an injector head, the injector head comprising:

an injector body comprising an injector portion shaped as a hyperbolic funnel rotated around an assembly axis, wherein, in a cross section along the assembly axis, a wall of the injector portion transitions from a radial axis, which is orthogonal to the assembly axis, to an axis that is parallel to the assembly axis; and a premix barrel encircling the injector portion around the assembly axis and defining a premix passage wherein air and fuel are mixed, the premix passage located between the premix barrel and the injector, the premix barrel further comprises a plurality of vanes in the premix passage and spaced apart at equidistant intervals circumferentially around at least a portion of the injector portion and around the assembly axis, wherein each of the plurality of vanes comprises a fuel passage in an interior of each vane and one or more fuel outlets connecting the fuel passage to the premix passage, wherein a radial portion of the wall of the injector portion that is along the radial axis comprises a plurality of purge holes that connect the premix passage to an injector cavity, which is radially interior to the premix passage and wherein each of the plurality of purge holes is positioned on the radial portion of the wall of the injector portion along the radial axis between the assembly axis and one of the plurality of vanes, and wherein each of the plurality of purge holes comprises an inlet portion parallel to a radial direction with respect to the assembly axis and an outlet portion parallel to the assembly axis;

a distribution block;

a main fuel fitting connected to the distribution block;

a pilot fuel fitting;

one or more main fuel tubes that connect the distribution block to the injector head, wherein the distribution block and each of the one or more main fuel tubes comprises a passage for fluid communication between the main fuel fitting and a main fuel gallery in the injector head; and a tube stem that connects the pilot fuel fitting to the injector head, wherein the tube stem comprises a passage for fluid communication between the pilot fuel fitting and a pilot fuel gallery in the injector head.

12. The fuel injector of claim 11, wherein the one or more main fuel tubes comprise at least two main fuel tubes.

13. The fuel injector of claim 11, wherein the one or more main fuel tubes comprise at least three main fuel tubes, wherein two of the at least three main fuel tubes are parallel to each other, and wherein one of the at least three main fuel tubes is angled with respect to the two of the at least three main fuel tubes.

14. The fuel injector of claim 13, wherein the two of the at least three main fuel tubes, are parallel to the assembly axis.

15. The fuel injector of claim 11, wherein the injector body further comprises:

for each of the plurality of vanes, a fuel passage that connects the fuel passage in each vane to the main fuel gallery;

one or more feed passages that connect the injector cavity to an exterior of the injector body that is upstream from the injector cavity;

an axial downstream flow path from the one or more feed passages through the injector cavity to an opening in a downstream end of the injector portion;

a central portion that is coaxial to the injector portion and within the injector cavity, wherein the central portion comprises an axial downstream flow path from the pilot fuel gallery to an opening in a downstream end of the central portion; and a pilot tube that is coaxial to and encircled by the central portion.

16. A gas turbine engine comprising:

a compressor;

a turbine; and a combustor between the compressor and the turbine, wherein the combustor comprises the fuel injector of claim 11.

17. The gas turbine engine of claim 16, wherein the combustor comprises a plurality of the fuel injector, and wherein the plurality of the fuel injector is arranged circumferentially around a longitudinal axis of the gas turbine engine within the combustor.

18. A fuel injector for a gas turbine engine, the fuel injector comprising:

a main fuel fitting;

an injector head; and one or more main fuel circuits from the main fuel fitting through the injector head;

wherein the injector head comprises an injector portion shaped as a hyperbolic funnel rotated around an assembly axis of the injector head, wherein, in a cross section along the assembly axis, a wall of the injector portion transitions from a radial axis, which is orthogonal to the assembly axis, to an axis that is parallel to the assembly axis; and a premix barrel encircling the injector portion around the assembly axis and defining a premix passage wherein air and fuel are mixed, the premix passage located between the premix barrel and the injector portion, wherein the premix barrel comprises a plurality of vanes arranged circumferentially around at least a portion of the injector portion and around the assembly axis, wherein each of the plurality of vanes comprises a fuel passage in an interior of each vane and one or more fuel outlets connecting the fuel passage to the premix passage, wherein a radial portion of the wall of the injector portion that is along the radial axis comprises a plurality of purge holes that connect the premix passage to an injector cavity radially interior of the premix passage, wherein the plurality of purge holes is in one-to-one correspondence with the plurality of vanes, wherein each of the plurality of purge holes is positioned on the radial portion of the wall of the injector portion along the radial axis between the assembly axis and one of the plurality of vanes, and wherein each of the plurality of purge holes comprises an inlet portion parallel to a radial direction with respect to the assembly axis and an outlet portion parallel to the assembly axis.

* * * * *